United States Patent [19]

Goncalves

[11] Patent Number: 4,901,882

[45] Date of Patent: Feb. 20, 1990

[54] CASE WITH A HINGED COVER

[75] Inventor: Antonin Goncalves, Montmorency, France

[73] Assignee: L'Oreal, Paris, France

[21] Appl. No.: 314,106

[22] Filed: Feb. 23, 1989

[30] Foreign Application Priority Data

Feb. 24, 1988 [FR] France ..... 88 02220

[51] Int. Cl.[4] ..... B65D 45/16

[52] U.S. Cl. ..... 220/324; 220/326; 220/337

[58] Field of Search ..... 220/324, 334, 337, 338, 220/340, 342, 326

[56] References Cited

U.S. PATENT DOCUMENTS

| | | | |
|---|---|---|---|
| 1,485,050 | 2/1924 | Phillips . | |
| 3,524,564 | 8/1970 | Schurman | 220/324 |
| 3,799,391 | 3/1974 | Brescia | 220/324 |
| 3,822,906 | 7/1974 | Gaines | 220/324 |
| 3,825,110 | 7/1974 | Halbich et al. | 220/324 |
| 4,501,378 | 2/1985 | Berfield | 220/324 |

FOREIGN PATENT DOCUMENTS

| | | |
|---|---|---|
| 0002443 | 6/1979 | European Pat. Off. . |
| 0036078 | 9/1981 | European Pat. Off. . |
| 3606510 | 9/1987 | Fed. Rep. of Germany . |
| 566996 | 2/1924 | France . |
| 910586 | 6/1946 | France . |
| 2595663 | 10/1988 | France . |

*Primary Examiner*—Joseph Man-Fu Moy

*Attorney, Agent, or Firm*—Cushman, Darby & Cushman

[57] ABSTRACT

The invention relates to cases, in particular cases for packaging cosmetic products, provided with a closure device including a movable element comprising a tilting pushbutton (5) in the form of a T, the top beam of which includes a control bar (51) projecting from the front edge (1') of the lid (1) in the closure position, and on the back a pivot (53, 53'), and the central leg of which comprises a latching prong (58) provided with a hook member (59). The movable element cooperates with fixed elements (6) of the lid including a front crtadle (64), at least one tongue (65), and a window (61) and fixed elements of the base (2) including a recess (74) for the latching prong (58) and a retention member (73) that is complementary with the hook member (59) of the prong (58).

12 Claims, 3 Drawing Sheets

CASE WITH A HINGED COVER

FIELD OF THE INVENTION

The present invention relates to cases, including a base and a lid connected to one another by a hinge or pivotable joint, and provided with a closure device including at least one movable element cooperating with fixed elements of the lid and case. These cases can be used for any kinds of package but are particularly suitable to the packaging of cosmetic products or makeup products.

BACKGROUND OF THE INVENTION

Numerous cases including a base and a lid connected to one another by a joint are known. This joint may comprise a cylindrical joint, a hinge, a flexible substance capable of folding, or any similar device making it possible for the lid to pivot with respect to the base when the case is opened and closed. Typically, a closure device or clasp is located in a zone remote from the joint. In the ensuing description, the portion including the closure device will be called the case, and the side that includes the joint will be called the back.

Quite numerous closure devices are known, which include portions integral with the lid on the one hand and the base on the other, facing one another and having complementary shapes. In many cases, to obtain the function of the closure device, the more or less flexible property of the material comprising the case, and consequently of the portions integral with the lid and the base, is made use of. However, the devices of this type used thus far necessitate either staggering the fingers with respect to one another to open a lid, or pressing on the upper or lower part of the case. In these cases, the gesture is neither natural nor self-evident, and users find it difficult to comprehend how the device functions in order to begin opening it.

In French Patent Application No. 2 595 663, a system is described including a movable V-shaped element embodied by a pushbutton located at one end of the V and projecting from the upper face of the lid, and a flexible locking arm including an enlargement which cooperates with fixed elements of the case. Opening is done simply by pressing vertically on a pushbutton. This closure system has the advantage of including an element that is manufactured independently of the case and hence can be made of a different material from that of the case, for example a material that is more flexible or more wear-resistant. However, this system has some disadvantages when the cases must be stored by stacking one above the other, because the pushbutton is located on the upper part of the lid.

SUMMARY OF THE INVENTION

The present invention relates to a case including a closure device that avoids the aforementioned disadvantages and which combines the advantages of a device in which opening is performed by simple pressure on a pushbutton with those of a device located on the front of the case. In addition, the device according to the invention has numerous other advantages that will be described below.

The present invention relates to a case including a base and a lid, joined to one another by a joint provided with a closure device, which is located in a zone remote from the joint and which includes at least one movable element cooperating with fixed elements located on the lid and the base of the case, the movable element including a control bar that projects outside the case in the closing position of the case, characterized in that, first: the movable element is a T-shaped tilting pushbutton comprising a top beam and a central leg, the top beam including, toward the front of the case, the control bar projecting at the forward edge of the lid in the closing position and on the back, toward the joint of the case, a pivot, the mean plane of the control bar being substantially parallel to the axis of the pivot but not containing it, the central leg comprising a latching prong that has a hooking means at its lower end; second: the fixed elements of the closure device carried by the lid define, on the front edge of the lid, a passageway window for the control bar of the tilting pushbutton, including a front cradle which supports the pivot of the tilting pushbutton, the front cradle being carried on the inside by a front edge of the lid and also, on the one hand, a back stop on which the tilting pushbutton comes to rest when the control bar is subjected to a thrust oriented toward the inside of the case, on the other hand at least one elastic tongue which rests on the tilting pushbutton of the back side of the control bar, in order to push the bar back toward the front of the case and to keep the pivot resting against its front cradle; and third: fixed elements of the closure device that are located on the base of the case define a recess located against the front edge of the base of the case, the recess receiving the latching prong when the case is in the closing position, the wall of the recess perpendicular to the base of the case and located toward the inside of the case including a retention means complementary to the hooking means of the latching prong.

According to the present invention, the fixed elements of the lid preferably include a rear cradle making it possible to immobilize the pivot of the tilting pushbutton in terms of translation, the pivot being held between the front cradle and the rear cradle and held pressed against the front cradle by the elastic tongue.

The latching means preferably is a notch defining a concave seat, the retention means carried by the wall of the recess of the base of the case being an enlargement capable of being seated in the concave seat.

The fixed elements of the lid preferably include two elastic tongues disposed symmetrically with respect to the back stop against which the tilting pushbutton comes to rest.

The pivot of the tilting pushbutton preferably comprises two journals separated by a flattened face, and the front cradle located in the lid comprises two half-cradles supporting the two journals.

The rear cradle belonging to the fixed elements of the lid preferably comprises a plate substantially parallel to the mean plane of the window of the front edge of the lid; this plate includes a cut in its lower portion.

The back stop on which the tilting pushbutton comes to rest preferably includes an oblique surface complementary to an oblique segment of the control bar, the oblique segment coming in contact with the oblique surface when the control bar is at the end of its course of travel into the case.

On the back side of the control bar and vertically of the elastic tongue or tongues, the tilting pushbutton preferably includes a substantially plane surface on which the tongue or tongues come to rest when the control bar is in the position of closure of the case.

The front face of the control bar has a plane, oblique or convex shape which adapts to the front edge of the lid on which it projects.

The movable element according to the present invention is preferably a single part obtained by molding of a plastic material. This plastic material may be different from that comprising the fixed elements. In particular, the plastic material is a substance of great hardness, such as styrenemaleic anhydride copolymers.

The closure device according to the invention has numerous advantages. It enables the user to comprehend the closure system immediately. To unlatch the case, one need merely press on a clearly evident pushbutton located on the front part of the lid. On the other hand, because of the action of the tongues that act as a spring, latching takes place automatically as soon as to the lid is re-closed. The movement of the tilting pushbutton is kinematically rational, because it pivots about an axis. By adjusting the length of the latching prong, it is easily possible to control the flexibility in function, which varies depending on the thickness of the case.

The present invention will be better understood from the ensuing detailed description of an entirely exemplary embodiment shown in the accompanying drawings.

DESCRIPTION OF THE PREFERRED EMBODIMENTS

Figure 1:
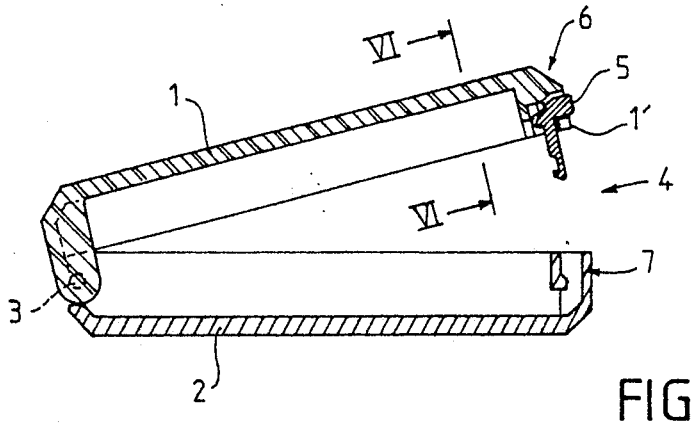
FIG. 1 is a sectional view of a case including the closure device according to the invention.
Figure 5:
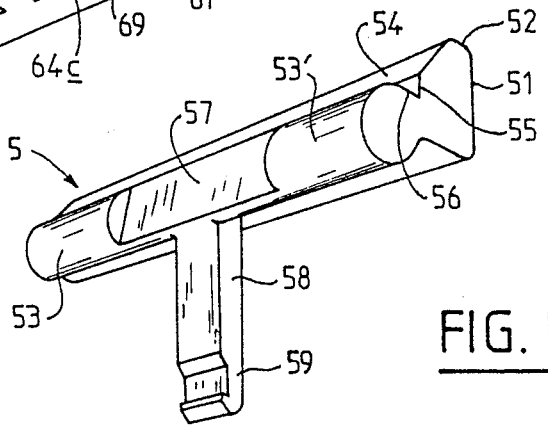
FIG. 5 is a perspective view of the tilting pushbutton.
Figure 10:
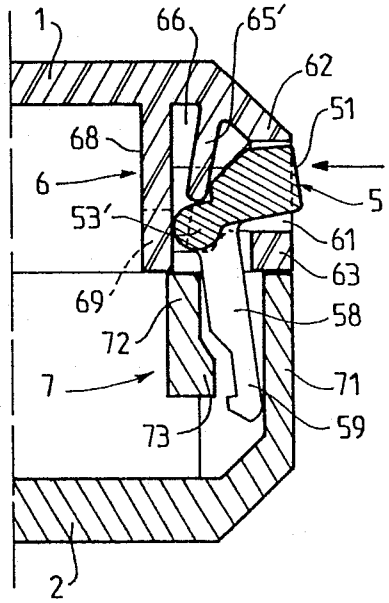
FIG. 10 is a view taken along the line IX—IX of the closure device in the opening position.
Figure 9:
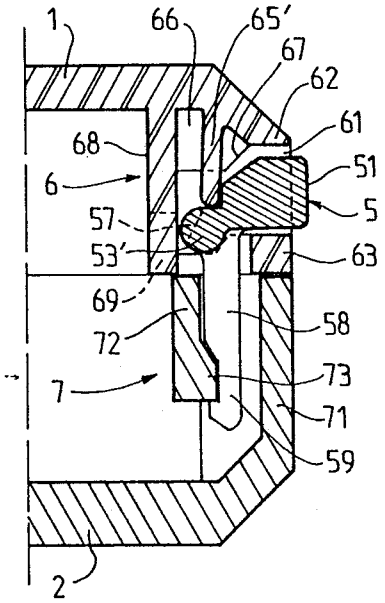
FIG. 9 is a view taken along the line IX—IX of the closure device in the closed position.
Figure 8:
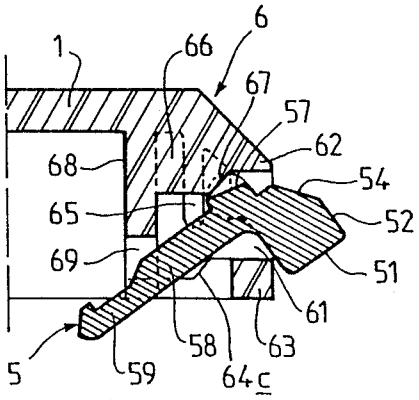
FIG. 8 is a sectional view taken along the line VIII—VIII of the closure device, showing the phase of introduction of the movable element.

As shown in FIG. 1, in its upper portion, the case includes a lid 1 and in its "lower" portion a base 2, which are connected at the side (hereinafter called the "back") by joint 3 about which the lid 1 can pivot about the base 2 when the case is opened and closed. The case may be of any shape: rectangular, square, round, oval, and so forth. The joint 3 may be a hinge, as shown in the accompanying drawing, but may equally be any known device making it possible for the lid to pivot with respect to the base. On the side of the case farthest from the joint 3 (hereinafter called the "front" side), is the closure device 4. This closure device 4 includes a tilting pushbutton 5, as its movable element, associated with fixed elements 6 located in the lid 1 of the case, and associated with elements 7 located in the base 2 of the case. The fixed elements 6 and 7 are face-to-face, so as to be able to cooperate with the tilting pushbutton 5. In the ensuing description, the device 4 is described in the closing position. The tilting pushbutton 5 is in the shape of a T having a top beam and a central leg. The top beam of the T, at the front, includes a control bar 51 projecting from the front edge 1' of the lid. This control bar 51 may include a plane surface on the front, as shown in FIGS. 8–10, or an oblique surface 52, as shown in FIG. 5, for adaptation to the shape of the front edge 1' of the lid. It may also include a convex surface. In the embodiment shown in FIG. 5, a pivot comprising two journals 53 and 53' is disposed on the back of the top beam. The journals are separated by a flattened surface 57. The journals 53, 53' are connected, on the side of the central leg, to the control bar 51 by a continuous inclined surface. On the opposite side, they are connected via an oblique plane 54 and a plane 55 that is substantially parallel to the central leg of the T. A throat 56 that is substantially parallel to the bar of the T is located between the plane 55 and the two journals 53, 53'. The two journals 53, 53' are fixed to the bar of the T by a surface that is as small as possible but nevertheless is sufficient to assure a suitable mechanical resistance. In another embodiment, the pivot does not include the flattened surface. The central leg of the T comprises a latching prong 58 substantially disposed along the axis of symmetry of the tilting pushbutton 5. The latching prong 58 has an elongated parallelepiped or cylindrical shape. In its portion farthest away from the top beam of the T, it is provided with a hooking means 59, which is a notch defining a concave seat.

Figure 4:
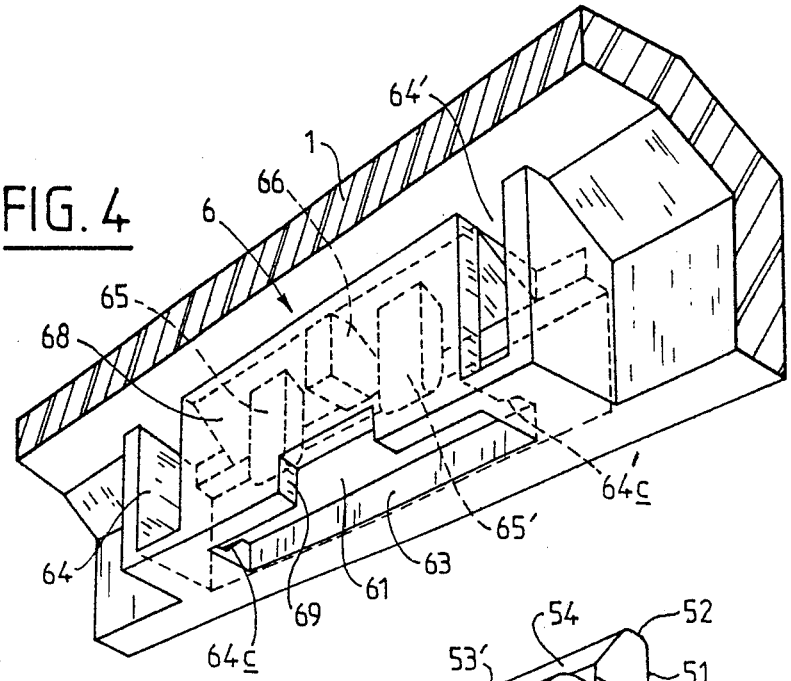
FIG. 4 is a perspective view from below of the fixed elements located in the lid of the case.
Figure 6:
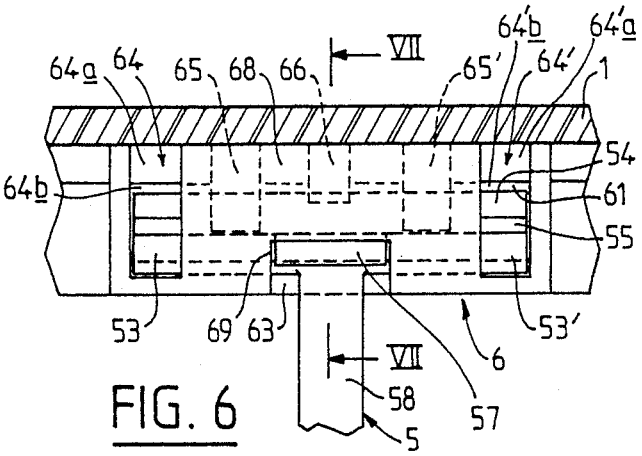
FIG. 6 is a view taken along the line VI—VI of the fixed elements located in the lid of the case.
Figure 7:
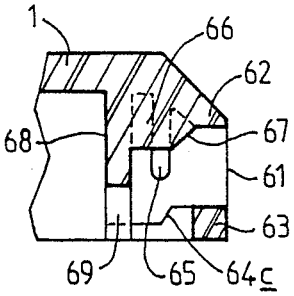
FIG. 7 is a sectional view along the line VII—VII of the device.

The fixed elements 6 of the closure system located in the lid 1 are shown in greater detail in FIGS. 4, 6 and 7. On the front edge 1' of the lid, they define a window 61 in which the bar 51 passes that projects from the front edge 1' of the lid. This window is defined on the upper side of the lid by a rim 62 and laterally by two partitions. The lower rim is limited by a parallelepiped bar 63, at each end of which is a front half-cradle 64, 64'. In another embodiment, the cradle may comprise the lower rim over the entire length of the cradle. These two half-cradles, beginning at the front face of the case, successively have a plane parallel to the surface of the lid 64*a*, 64'*a*, an inclined plane 64*b*, 64'*b* and a plane surface 64*c*, 64'*c*. The set formed by the inclined plane 64*b*, 64'*b* and the plane 64*c*, 64'*c* can be replaced with a concave surface. The journals 53 and 53' rest on the inclined planes 64*b*, 64'*b* and on the plane 64*c*, 64'*c*.

In a plane that is substantially perpendicular to the upper portion of the lid 1, there are two tongues 65, 65' fixed to the inside of the upper portion of the lid 1. They are substantially symmetrical with respect to the median plane perpendicular to the lid of the passageway window 61. These tongues are of a slight thickness, so that they have a certain elasticity. They rest on the plane 55 that is substantially parallel to the central leg of the T of the tilting pushbutton. A back stop 66 is fixed to the back of the tongues 65, 65'. It has the same median plane perpendicular to the surface of the lid as the window 61. In the embodiment shown, in a section perpendicular to the upper surface of the lid 1, the back stop 66 has the shape of a right trapezoid, where the short side is located toward the bottom (that is, the bottom side of the lid) and the side 67 is inclined toward the front.

Behind the tongues 65, 65' and the back stop 66 is a rear cradle 68, which in the embodiment shown comprises a plate fixed to the inside portion of the surface of the lid 1. The cradle 68 is provided with a cut, which in the embodiment shown is rectangular. The cradle 68 in a different embodiment could comprise two symmetrically arranged half-cradles. The journals 53, 53' come to rest on the rear cradle 68, which makes it possible to immobilize them in terms of translation.

Figure 3:
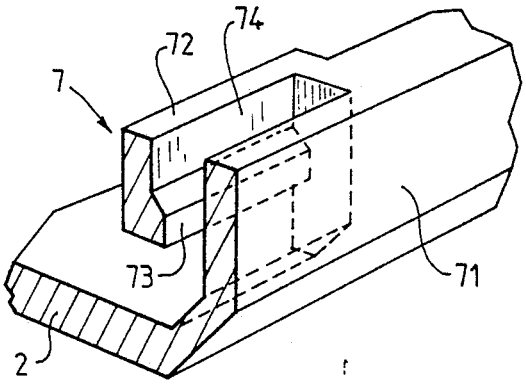
FIG. 3 is a perspective view of the fixed elements located in the base of the case.
Figure 2:
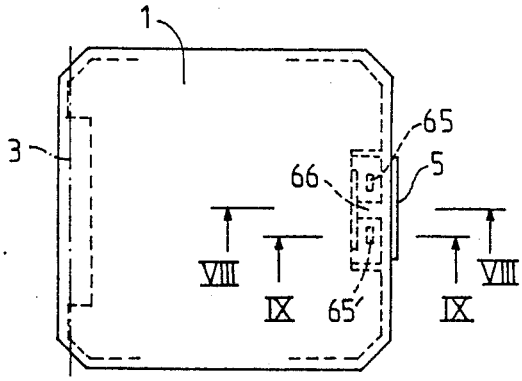
FIG. 2 is a view from above of a case according to the invention.

The fixed elements of the device located on the bottom 2 of the case are shown in further detail in FIG. 3. These elements form a recess 74 defined by the bottom surface of the base 2 of the case, the front wall 71 and a partial partition 72 located farther to the back. This partition 72 makes a space between its lower portion and the inside surface of the base of the case. An enlargement 73 having a shape complementary to that of the hooking notch 59 is located in the lower portion of the partition 72.

To open the case, one pushes on the control bar 51 of the tilting pushbutton 5. The pushbutton tilts by turning about the journals 53 and 53'.

These journals in fact pivot on the inclined surfaces **64*b*, 64'*b* and the plane surfaces 64*c* and 64'*c* of the front half-cradle 64 and 64' and on the rear cradle 68, until the oblique plane 52 of the tilting pushbutton comes into contact with the front inclined side 67 of the rear stop 66. Simultaneously, the elastic tongues 65 and 65' are pushed back to the front and the latching prong 58 is displaced toward the front in the recess 74, and the hooking notch 57 is disconnected from the enlargement 73. The latching prong may then leave the seat 74 completely, and the opening of the case is complete. When the case is closed, the latching takes place automatically as soon as the latching prong 58 is within the seat 74, because the elastic tongues 65, 65' acting as a spring and pressing on the surface 55 push the tilting pushbutton 5** back into the closing position.

The closure system is very simple to assemble. The tilting pushbutton 5 is introduced through the window 61. The flattened surface 57 provided between the two journals makes it possible for the tilting pushbutton 5 to pass through to the level of the back stop 66. Furthermore, the rectangular cut 69 in the cradle 68 enables the passage and tilting of the latching prong 58 in the central recess 74. In the embodiment shown in the accompanying drawings, the tilting pushbutton 5 is in a single part, which can easily be prepared by any standard method for molding a plastic material. The fixed elements 6 of the lid and the fixed elements 7 of the base of the case can also be easily made by molding them simultaneously with the lid of the case. It is sufficient to provide mold slides of conventional shape in the molds.

What is claimed is:

1. A case including a base and a lid, joined to one another by joint means and provided with a closure device, which is located in a zone remote from the joint means and which includes at least one movable element cooperating with fixed elements located on the lid and the base of the case, the lid having a front edge and a window therethrough, the movable element including a control element that projects outside the case in the closing position of the case, wherein:

the movable element is a T-shaped tilting pushbutton comprising a top beam and a central leg, said top beam including, toward the front of the case, the control element projecting at the front edge of the lid in the closing position through said window and on the back thereof having, toward the joint means of the case, pivot means, the control element having a mean plane and the mean plane of the control element being substantially parallel to the axis of the pivot means but external to said pivot means of said control element, said central leg comprising a latching prong and a lower end that has a hooking means;

the fixed elements of the closure device carried by the lid define, on the front edge of the lid, said window for the control element of the tilting pushbutton, and including a front cradle which supports the pivot means of the control element of the tilting pushbutton, said front cradle being carried on the inside by a front edge of the lid and also, on the one hand, a back stop on which the tilting pushbutton comes to rest when the control element is subjected to a thrust oriented toward the inside of the case, at least one elastic tongue which rests on the tilting pushbutton on the back side of the control element, in order to push said control element back toward the front of the case and to keep the pivot means resting against said front cradle; and other fixed elements of the closure device that are located on the base of the case define a recess located against the front edge of the base of the case, said recess receiving the latching prong when the case is in the closing position, the wall of the recess perpendicular to the base of the case and located toward the inside of the case including a retention means complementary to the hooking means of the latching prong.

2. A case as defined by claim 1, characterized in that the fixed elements of the lid include a rear cradle making it possible to immobilize the pivot means of the tilting pushbutton in terms cf translation, said pivot means being held between the front cradle and the rear cradle and held pressed against the front cradle by the elastic tongue.

3. A case as defined by claim 1 or 2, characterized in that the latching prong is a notch defining a concave seat, the retention means carried by the wall of the recess of the base of the case being an enlargement capable of being seated in said concave seat.

4. A case as defined by claim 3, characterized in that the fixed elements of the lid include two elastic tongues disposed symmetrically with respect to the back stop against which the tilting pushbutton comes to rest.

5. A case as defined by one of the claims 1 or 2, characterized in that the pivot means of the tilting pushbutton preferably comprises two journals separated by a flattened face, the front cradle located in the lid comprising two half-cradles supporting the two journals.

6. A case as defined by one of the claims 1 or 2, characterized in that the rear cradle that is part of the fixed elements of the lid comprises a plate substantially parallel to the mean plane of the window of the front edge of the lid, said plate including a cut in its lower part.

7. A case as defined by claims 1 or 2, characterized in that the back stop on which the tilting pushbutton comes to rest includes an oblique surface complementary to an oblique segment of the control element, said oblique segment coming in contact with said oblique surface when the control element is at the end of its course of travel into the case.

8. A case as defined by claim 7, characterized in that, on the back side of the control element, the tilting pushbutton includes a substantially plane surface on which the tongue or come to rest when the control element is in the position of closure of the case.

9. A case as defined by claims 1 or 2, characterized in that the front face of the control element has a plane shape which adapts to the front edge of the lid on which it projects.

10. A case as defined by claims 1 or 2, characterized in that the front face of the control element has a convex shape which adapts to the front edge of the lid on which it projects.

11. A case as defined by claims 1 or 2, characterized in that the front face of the control element has an oblique shape which adapts to the front edge of the lid on which it projects.

12. A case as defined by claim 9, characterized in that the pushbutton is a single part obtained by molding of a plastic material.

* * * * *